US009632460B1

(12) United States Patent
Seko et al.

(10) Patent No.: US 9,632,460 B1
(45) Date of Patent: Apr. 25, 2017

(54) BELT-SHAPED MEMBER, IMAGE TRANSPORT DEVICE, AND IMAGE FORMING APPARATUS

(71) Applicant: FUJI XEROX CO., LTD., Tokyo (JP)

(72) Inventors: Masayuki Seko, Kanagawa (JP); Hiromoto Yamaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/132,281

(22) Filed: Apr. 19, 2016

(30) Foreign Application Priority Data

Dec. 9, 2015 (JP) ..... 2015-239892

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1615
USPC ..... 399/302
See application file for complete search history.

(56) References Cited

U.S. PATENT DOCUMENTS 6,674,989 B1 1/2004 Kusaba et al.
2003/0202819 A1* 10/2003 Matsuda ..... G03G 15/755 399/121
2004/0062567 A1* 4/2004 Matsuda ..... G03G 15/1615 399/121
2010/0221042 A1* 9/2010 Fujita ..... G03G 15/1615 399/165

FOREIGN PATENT DOCUMENTS

JP 2001-122417 A 5/2001
JP 2009-181035 A 8/2009

* cited by examiner

*Primary Examiner* — Hoang Ngo
(74) *Attorney, Agent, or Firm* — Oliff PLC

(57) ABSTRACT

A belt-shaped member includes an endless belt-shaped base member that has a circumferential edge and that is supported by plural support members. The belt-shaped member also includes a meandering preventing member that is provided along the circumferential edge of the base member and that has a bonding surface bonded to the base member. When a diameter of at least one of the plural support members is 25 mm or less, a protective film having a thickness of from 5 to 20 μm is formed on the bonding surface of the meandering preventing member.

10 Claims, 6 Drawing Sheets

FIG. 6

| | | DIAMETER OF DRIVE ROLLER (mm) | | | |
|---|---|---|---|---|---|
| | | APPARATUS MODEL A | APPARATUS MODEL B | APPARATUS MODEL C | APPARATUS MODEL D |
| | | 13 | 22.5 | 25.7 | 30 |
| THICKNESS OF PROTECTIVE FILM (μm) | 25 | B | B | | |
| | 20 | A | A | | |
| | 5 | A | A | | |
| | 3 | B | B | A | A |
| | 0 | | | A | A |

BELT-SHAPED MEMBER, IMAGE TRANSPORT DEVICE, AND IMAGE FORMING APPARATUS

CROSS-REFERENCE TO RELATED APPLICATIONS

This application is based on and claims priority under 35 USC 119 from Japanese Patent Application No. 2015-239892 filed Dec. 9, 2015.

BACKGROUND

Technical Field

The present invention relates to a belt-shaped member, an image transport device, and an image forming apparatus.

SUMMARY

According to an aspect of the present invention, a belt-shaped member includes an endless belt-shaped base member that has a circumferential edge and that is supported by plural support members. The belt-shaped member also includes a meandering preventing member that is provided along the circumferential edge of the base member and that has a bonding surface bonded to the base member. When a diameter of at least one of the plural support members is 25 mm or less, a protective film having a thickness of from 5 to 20 μm is formed on the bonding surface of the meandering preventing member.

BRIEF DESCRIPTION OF THE DRAWINGS

Exemplary embodiment of the present invention will be described in detail based on the following figures, wherein:

FIG. 6 is a table that lists examples, comparative examples, and reference examples so as to illustrate the relationship between the diameter of a drive roller and the thickness of a protective film.

DETAILED DESCRIPTION

Next, an exemplary embodiment of the present invention will be described in detail with reference to the drawings.

Figure 1:
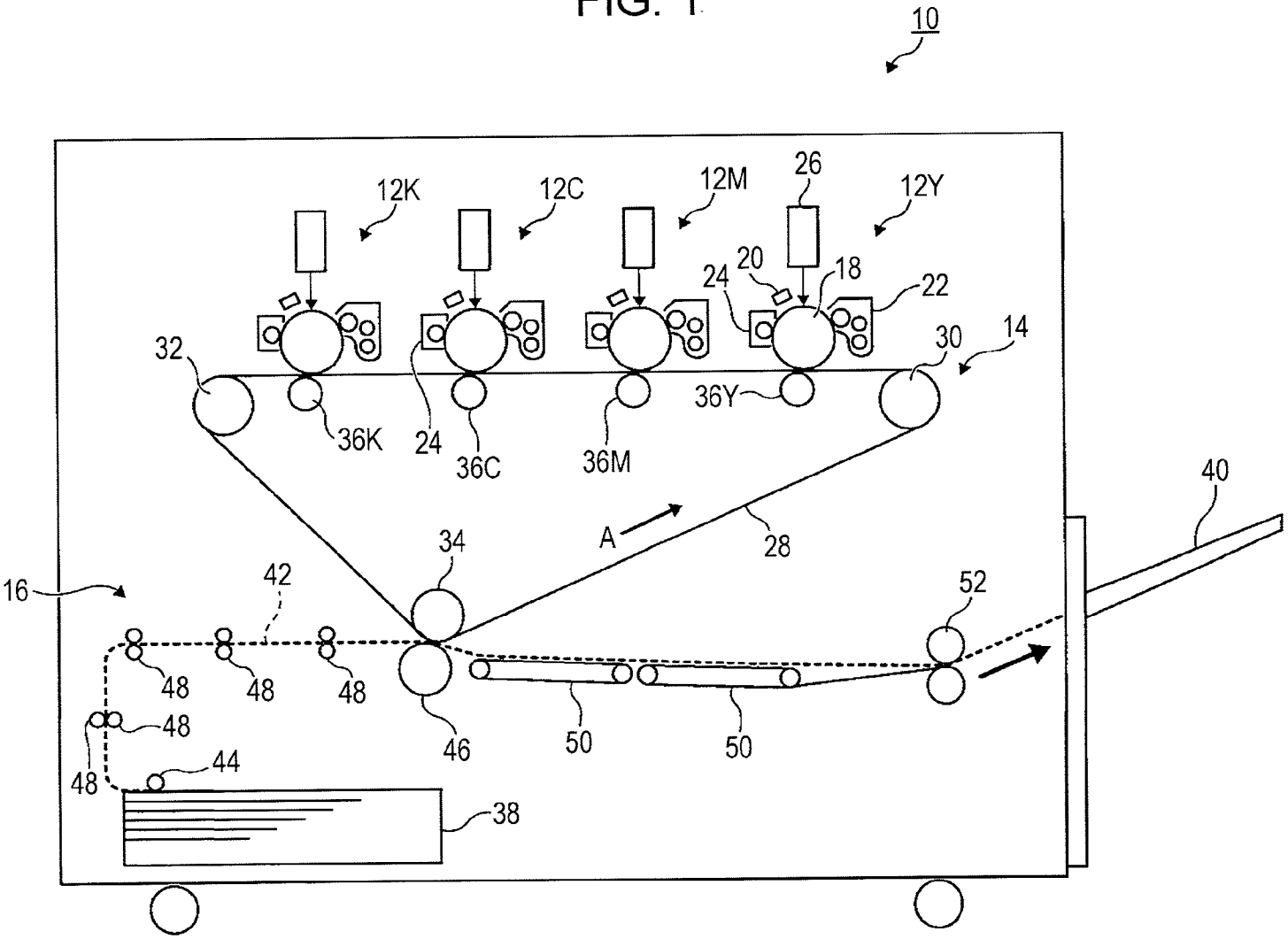
FIG. 1 is a side view of an image forming apparatus according to an exemplary embodiment of the present invention.

FIG. 1 illustrates a structure of an image forming apparatus 10 according to the exemplary embodiment of the present invention.

The image forming apparatus 10 includes, for example, four image forming units 12Y, 12M, 12C, and 12K, an intermediate transfer device 14, and a sheet transport device 16.

The image forming units 12Y, 12M, 12C, and 12K are horizontally arranged so as to be spaced from one another at certain intervals. According to the present exemplary embodiment, the yellow (Y), magenta (M), cyan (C), and black (K) image forming units 12Y, 12M, 12C, and 12K are arranged in this order. However, the order may be any order such as an order in which the black (K), yellow (Y), magenta (M), and cyan (C) image forming units 12K, 12Y, 12M, and 12C are arranged in this order.

Each of the image forming units 12Y, 12M, 12C, and 12K includes a photosensitive drum 18, a charger 20, a developing device 22, and a cleaner 24. The charger 20 serving as a charging device uniformly charges a surface of the photosensitive drum 18. The developing device 22 develops an electrostatic latent image formed on the photosensitive drum 18. The photosensitive drum 18 is a cylindrical image holding body that holds a toner image (developer image). The photosensitive drum 18 is uniformly charged by the charger 20 and irradiated with laser light from an optical scanning device 26, thereby the electrostatic latent image is formed. The electrostatic latent image formed on the photosensitive drum 18 is developed by the developing device 22 with toner and transferred onto an intermediate transfer belt (belt-shaped member) 28 of the intermediate transfer device 14, which will be described later. The cleaner 24 removes residual toner, paper dust, and so forth adhering to the photosensitive drum 18 after the toner image has been transferred.

The intermediate transfer device 14 serving as an image transport device includes the intermediate transfer belt 28 serving as the belt-shaped member. The intermediate transfer belt 28 is rotated in an arrow A direction of FIG. 1. That is, the intermediate transfer belt 28 is looped over a drive roller 30, an idle roller 32, and a backup roller 34 under a certain tension. The drive roller 30, the idle roller 32, and the backup roller 34 serve as support members that support the intermediate transfer belt 28. According to the present exemplary embodiment, first transfer rollers 36Y, 36M, 36C, and 36K are disposed between the drive roller 30 and the idle roller 32. The first transfer rollers 36Y, 36M, 36C, and 36K each face a corresponding one the photosensitive drums 18 with the intermediate transfer belt 28 interposed therebetween so as to transfer the toner images formed on the photosensitive drums 18 onto the intermediate transfer belt 28.

The sheet transport device 16 is disposed below the intermediate transfer device 14. The sheet transport device 16 has a sheet transport path 42 through which a sheet of paper is transported from a sheet feeding unit 38 to a sheet output unit 40. A feed roller 44 and plural transport rollers 48 are provided to the sheet transport path 42. The feed roller 44 feeds the sheet from the sheet feeding unit 38. The transport rollers 48 transport the sheet having been fed by the feed roller 44 to a second transfer roller 46. The second transfer roller 46 faces the backup roller 34 with the intermediate transfer belt 28 interposed therebetween. The second transfer roller 46 transfers, through second transfer, images having been transferred from the photosensitive drums 18 to the intermediate transfer belt 28 through first transfer onto the sheet having been transported through the sheet transport path 42. A fixing roller 52 is provided downstream of the second transfer roller 46 with transport belts 50 interposed therebetween. The fixing roller 52 fixes, by heat and pressure, the images on the sheet onto which the images have been transferred through the second transfer. The sheet onto which the images have been fixed by the fixing roller 52 is output to the sheet output unit 40.

Next, the intermediate transfer belt 28 is described in detail.

Figure 2:
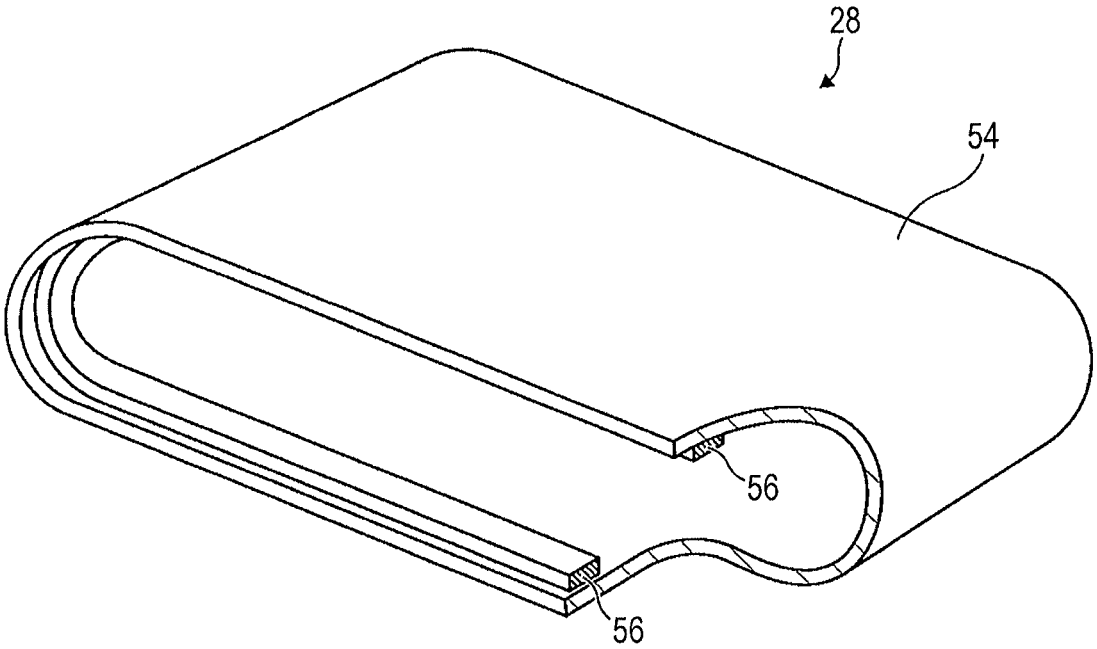
FIG. 2 is a perspective view of an intermediate transfer belt according to the exemplary embodiment of the present invention with part of the intermediate transfer belt removed.

The intermediate transfer belt 28 includes, as illustrated in FIG. 2, an endless belt-shaped base member 54 and meandering preventing members 56 provided at inner circumferential edges of the base member 54. The meandering preventing members 56 may be provided on one or both of the inner circumferential edges of the base member 54. According to the present exemplary embodiment, the meandering preventing members 56 are provided on both the circumferential edges of the base member 54.

The material of the base member 54 may be, for example, polyimide resin (PI), polyamide-imide resin (PAI), polyether ether ester resin, polyarylate resin, polyester resin, or polyester resin containing a reinforcing material added to the polyester resin. The base member 54 is formed by applying the resin to a circumferentially outer side of a cylindrical metal tool so as not to form a seam. The base member 54 contains carbon black dispersed therein so as to adjust electrical conductivity.

Figure 3:
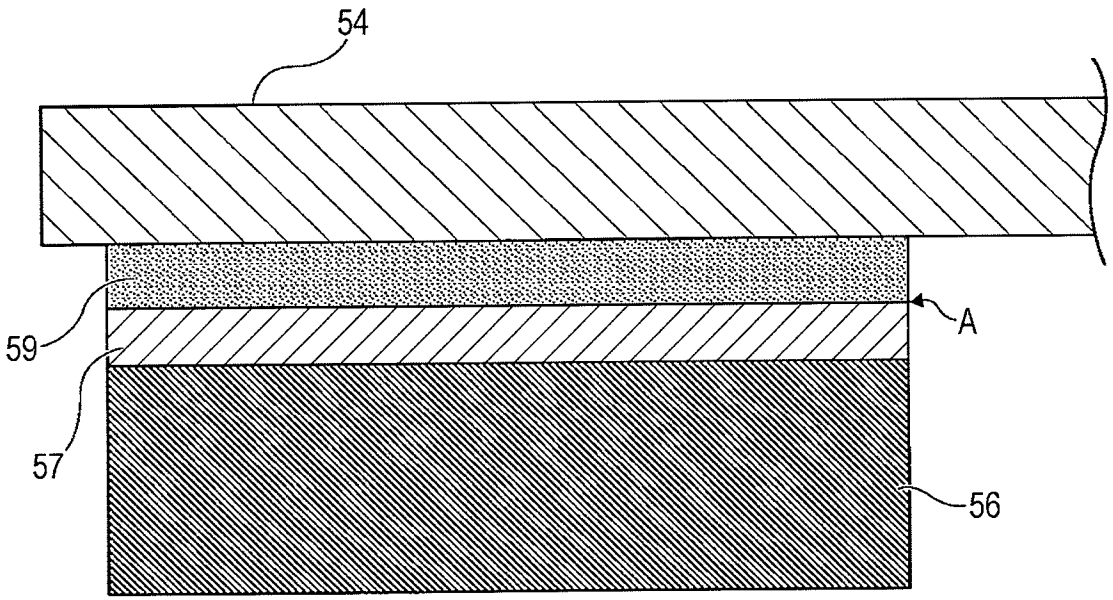
FIG. 3 is a sectional view of a meandering preventing member and a structure near the meandering preventing member of the intermediate transfer belt according to the exemplary embodiment of the present invention.

The meandering preventing members 56 are each formed of a polyester-based elastomer, polyurethane, neoprene rubber, polyurethane rubber, silicone rubber, a polyester elastomer, chloroprene rubber, nitrile rubber, or the like. The meandering preventing members 56 have, for example, a quadrangular section. As illustrated in FIG. 3, a protective film 57 is formed on a surface of each of the meandering preventing members 56, the surface being on the side to be bonded to the base member 54.

The protective film 57 is formed of an isocyanate-based film made of, for example, a mixture of polymethylene polyphenyl isocyanate and chlorinated polypropylene.

Each of the meandering preventing members 56 and the base member 54 are bonded to each other by a bonding layer 59 that contains, for example, acrylic modified silicone polymer as an elastic adhesive. That is, with the protective film 57 serving as a bonding surface A to be bonded to the base member 54, the meandering preventing member 56 is secured to the base member 54 by the bonding layer 59 along the circumferential edges of the base member 54.

Figure 4:
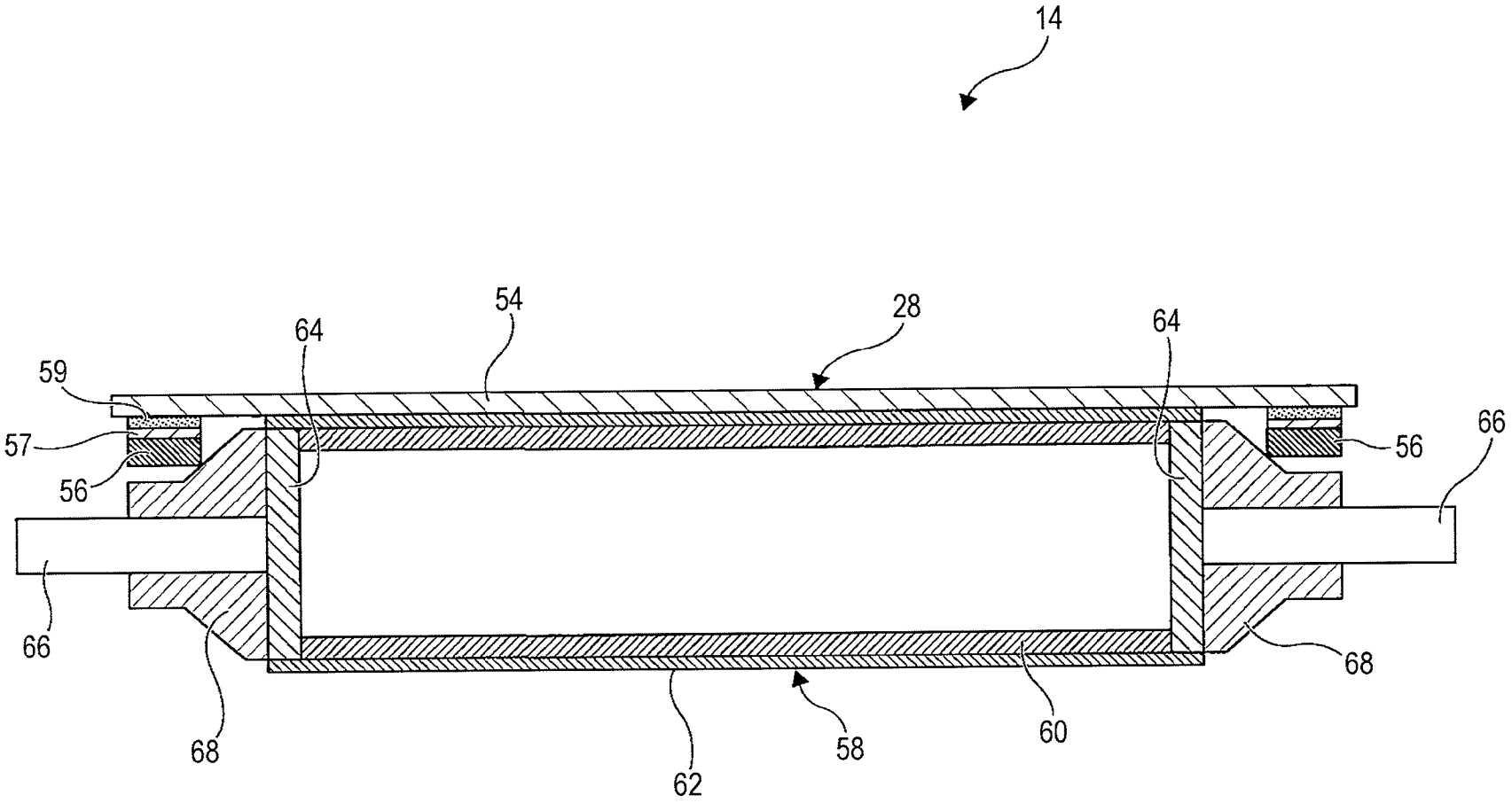
FIG. 4 is a sectional view of the structure of an intermediate transfer device used for the image forming apparatus according to the exemplary embodiment of the present invention.

The intermediate transfer belt 28 structured as described above is supported by the support members 58 as illustrated in FIG. 4. The support members 58 include, as has been described, the drive roller 30, the idle roller 32, and the backup roller 34. The support members 58 further include a steering roller and a tension roller.

The support members 58 each include a cylindrical roller body 60 formed of, for example, aluminum. A high-friction layer 62 formed of, for example, polyurethane covers the circumference of the roller body 60. The high-friction layer 62 is in contact with the base member 54 of the intermediate transfer belt 28 so as to suppress slipping between the support members 58 and the intermediate transfer belt 28.

The support members 58 each include lids 64 at both ends thereof and shafts 66 secured to the centers of the lids 64. The support member 58 is rotated about the shafts 66.

Furthermore, guide members 68 are secured to the lids 64 around the shafts 66. The guide members 68 are formed of a highly slidable material, for example, polyacetal. The guide members 68 have conical portions. The above-described meandering preventing members 56 are in contact with the respective conical portions.

By the contact of the meandering preventing members 56 with these guide members 68, the intermediate transfer belt 28 is guided so as not to meander.

Figure 5:
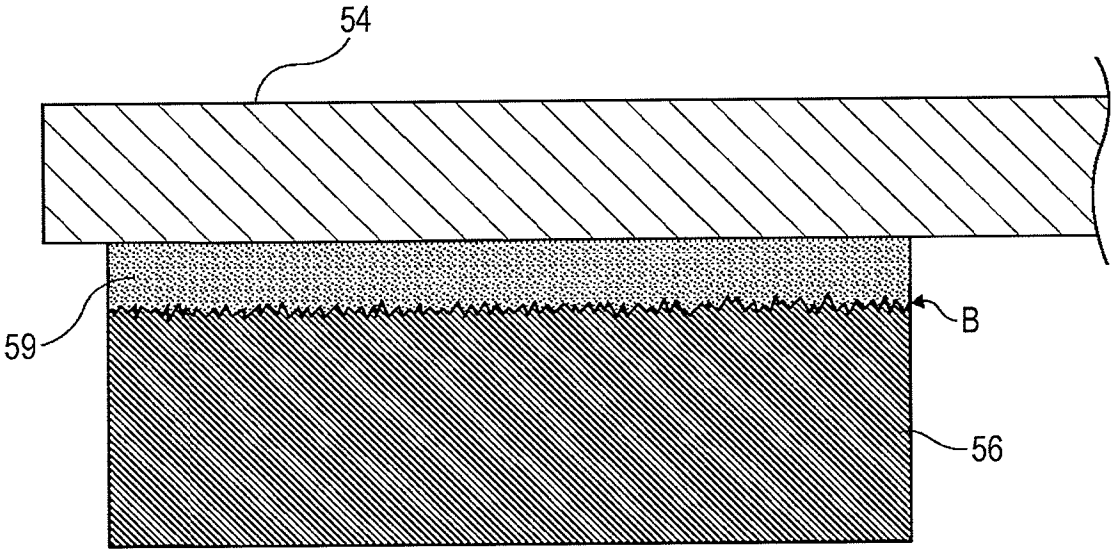
FIG. 5 is a sectional view of the meandering preventing member and a structure near the meandering preventing member of the intermediate transfer belt according to a comparative example.

Here, when the diameter of one of the support members 58 having a smallest diameter is 25 mm or less, as illustrated in FIG. 5, bleedout may occur acceleratedly in each of the meandering preventing members 56 in the case where the meandering preventing member 56 does not include the above-described protective film 57. Here, the bleedout refers to a phenomenon in which, when the compatibility between an additive and a polymeric compound in a polymeric material is not good, the additive floats to the surface over time. That is, by repeatedly bending the intermediate transfer belt 28, the additive in the meandering preventing member 56 may float to the surface (bonding surface B) of the meandering preventing member 56. This may cause separation of the meandering preventing member 56 from the base member 54.

Thus, even when the diameter of the support member 58 having a smallest diameter is 25 mm or less, the above-described situation is able to be addressed by forming the protective film 57 on the bonding surface of the meandering preventing member 56 to be bonded to the base member 54 and setting the thickness of the protective film 57 within a certain range.

An appropriate range of the thickness of the protective film 57 is able to be found by changing the thickness of the protective film 57 to a variety of values.

Examples, comparative examples, and reference examples are described below.

Intermediate transfer belts are prepared for the examples, the comparative examples, and the reference examples. Each of the intermediate transfer belts is prepared as follows.

The Base Member

Carbon black (FW1 from Degussa) is added to solvent-soluble polyamide imide resin (HPC-9000 from Hitachi Chemical Company, Ltd., with a solid content of 18%, solvent: n-methyl-2-pyrrolidone) so that 4% by mass of the carbon black is contained with respect to the mass of the solid content. A dispersion process (200 $N/mm^2$, 5 passes) is performed using a jet mill dispersing machine (GeanusPY from Geanus). The obtained polyamide imide solution containing the carbon black dispersed therein is caused to pass through a stainless 20 μm mesh, so that foreign matter and carbon black agglomerates are removed. Furthermore, the polyamide imide solution is subjected to vacuum deaeration for 15 minutes while being agitated so as to prepare a coating solution (solid content concentration of 21% by mass) for forming an endless belt. The prepared coating solution is applied to an outer surface of an aluminum pipe and dried at 150° C. for 30 minutes while being rotated. Next, this aluminum pipe is placed in an oven of 315° C. for one hour, and then removed from the oven. A resin film formed on the outer surface of the aluminum pipe is removed from the aluminum pipe. Thus, the base member having a thickness of 0.08 mm is obtained.

Meandering Preventing Member

A polyester-ether elastomer (from Tsuchiya Co., Ltd.) having a thickness of 1 mm is used. The meandering preventing member is made to have the following dimensions: the width is 5 mm; and the length is sufficient for the meandering preventing member to be bonded throughout one end portion of an inner circumferential surface of the base member. As a protective film, a mixture of polymethylene polyphenyl isocyanate and chlorinated polypropylene is applied to a bonding surface of the meandering preventing member to be bonded to the base member to a thickness of 0, 3, 5, 20, or 25 μm. This thickness is selected depending on one of the examples, the comparative examples, and the reference examples for which this meandering preventing member of intermediate transfer belt is used. Four of the meandering preventing member are prepared for the examples, four of the meandering preventing member are prepared for the comparative examples, and four of the meandering preventing member are prepared for the reference examples.

Bonding

As an elastic adhesive, Super-X No. 8008 from Cemedine Co., Ltd. containing an acrylic modified silicone polymer as a principal component is applied on the protective film side of the produced meandering preventing member to a thickness of 20 μm. Next, the meandering preventing member is placed at the one end portion of the inner surface of the base member in the width direction and pressed at a pressure of 0.03 MPa so as to produce the intermediate transfer belt having the meandering preventing member.

Evaluation

The intermediate transfer belts are assembled for four apparatus models A to D. In each of four apparatus models, one of the support members having a smallest diameter is the drive roller serving as a drive member. The diameters of the drive rollers are 13.0 mm for the apparatus model A, 22.5 mm for the apparatus model B, 25.7 mm for the apparatus model C, and 30.0 mm for the apparatus model D. Other support members and components used to assemble the apparatus models A to D are the same. The apparatus models C and D are listed as the reference examples.

Obtained results are listed in FIG. 6.

In the list of FIG. 6, "A" s represent that no separation of the meandering preventing member occurs after driving has been performed equivalent to 100,000 times, and "B" s represent that the separation of the meandering preventing member occurs before the number of times of the driving reaches equivalent to 100,000 times.

When the diameter of the drive roller is 13 mm and 22.5 mm, the results are "A" s, that is, no separation occurs when the thickness of the protective film is from 5 to 20 μm. In contrast, when the thickness of the protective film is less than 5 μm or more than 20 μm, the results is "B", that is, the separation occurs.

Furthermore, when the diameter of the drive roller is 25.7 mm and 30 mm as listed as the reference example, the results are "A" s independently of the thickness of the protective film, that is, no separation occurs.

That is, it may be thought that, when the thickness of the protective film is less than 5 μm, repeatedly bending the intermediate transfer belt (base member and meandering preventing member) by the drive roller having a diameter of 25 mm or less accelerates the bleedout in the meandering preventing member, and accordingly, the additive and a low molecular-weight compound contained in this meandering preventing member float to the surface (bonding surface) of the meandering preventing member, thereby causing the separation of the meandering preventing member from the base member.

It may also be thought that, when the thickness of the protective film is more than 20 μm, the protective film itself is cracked, thereby causing the separation of the meandering preventing member from the base member.

Thus, it may be appropriate that, in order to suppress the separation of the meandering preventing member from the base member when the diameter of the drive roller is 25 mm or less, the protective film having a thickness of from 5 to 20 μm be formed on the bonding surface of the meandering preventing member to be bonded to the base member.

Although the meandering preventing member is formed of the polyester-ether elastomer according to the exemplary embodiment, this is not limiting. The meandering preventing member may be formed of, for example, polyurethane, neoprene rubber, polyurethane rubber, silicone rubber, a polyester elastomer, chloroprene rubber, nitrile rubber, or the like.

Although the intermediate transfer device is the image transport device in the above-described exemplary embodiment and examples, this is not limiting. The image transport device may be a device with which an image having been transferred to a sheet is transported. In this case, a transport belt is used instead of the intermediate transfer belt.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt-shaped member comprising:

an endless belt-shaped base member that has a circumferential edge and that is supported by a plurality of support members; and a meandering preventing member that is provided along the circumferential edge of the base member and that has a bonding surface bonded to the base member, wherein, when a diameter of at least one of the plurality of support members is 25 mm or less, a protective film having a thickness of from 5 to 20 μm is formed on the bonding surface of the meandering preventing member.

2. The belt-shaped member according to claim 1, wherein the at least one of the plurality of support members includes a guide member that guides the meandering preventing member.

3. The belt-shaped member according to claim 2, wherein the at least one of the plurality of support members is a drive member.

4. The belt-shaped member according to claim 3, wherein the protective film is an isocyanate-based film.

5. The belt-shaped member according to claim 2, wherein the protective film is an isocyanate-based film.

6. The belt-shaped member according to claim 1, wherein the at least one of the plurality of support members is a drive member.

7. The belt-shaped member according to claim 6, wherein the protective film is an isocyanate-based film.

8. The belt-shaped member according to claim 1, wherein the protective film is an isocyanate-based film.

9. An image transport device comprising:

a plurality of support members; and a belt-shaped member supported by the plurality of support members, wherein the belt-shaped member includes an endless belt-shaped base member having a circumferential edge, and a meandering preventing member that is provided along the circumferential edge of the base member and that has a bonding surface bonded to the base member, and wherein, when a diameter of at least one of the plurality of support members is 25 mm or less, a protective film having a thickness of from 5 to 20 μm is formed on the bonding surface of the meandering preventing member.

10. An image forming apparatus comprising:

the image transport device according claim 9.

* * * * *